US009352595B2

(12) United States Patent
Yuda

(10) Patent No.: US 9,352,595 B2
(45) Date of Patent: May 31, 2016

(54) IMAGE FORMING APPARATUS AND IMAGE FORMING METHOD

(71) Applicant: Seiko Epson Corporation, Tokyo (JP)

(72) Inventor: Tomohiro Yuda, Minowa (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/920,248

(22) Filed: Oct. 22, 2015

(65) Prior Publication Data

US 2016/0114606 A1 Apr. 28, 2016

(30) Foreign Application Priority Data

Oct. 24, 2014 (JP) ..... 2014-217045

(51) Int. Cl.
*B41J 29/393* (2006.01)
*B41J 25/00* (2006.01)

(52) U.S. Cl.
CPC ..... *B41J 25/001* (2013.01)

(58) Field of Classification Search
CPC ..... B41J 29/393; B41J 2/2142; B41J 2/125; B41J 2/0451; B41J 13/0027; B41J 11/009; B41J 2/14153; B41J 11/42; B41J 2/04505; B41J 19/205; B41J 19/142; B41J 2/5056; B41J 2/07
See application file for complete search history.

(56) References Cited

U.S. PATENT DOCUMENTS 8,342,649 B2 * 1/2013 Yazawa ..... B41J 2/2132 347/40
8,356,882 B2 * 1/2013 Saito ..... B41J 2/2132 347/20
8,388,092 B2 3/2013 Kaizu et al.
8,845,063 B2 * 9/2014 Sano ..... B41J 2/07 347/15

FOREIGN PATENT DOCUMENTS

JP 2010-017976 A 1/2010
JP 2010-253841 A 11/2010

* cited by examiner

*Primary Examiner* — Lamson Nguyen
(74) *Attorney, Agent, or Firm* — Harness, Dickey & Pierce, P.L.C.

(57) ABSTRACT

An image forming apparatus includes a head; a scanning section; and a transport section. A first region is formed in the head between a nozzle formed at a first end and a first nozzle that is a first predetermined distance away, in the sub-scanning direction, from the nozzle formed at the first end. A second region is formed in the head between a nozzle formed at a second end and a second nozzle that is a second predetermined distance away, in the sub-scanning direction, from the nozzle formed at the second end. When the head, the scanning section, and the transport section form an image on the medium, a moving-average nozzle usage ratio within a region between the first region and the second region changes at a lower rate than moving-average nozzle usage ratios within the first region and the second region.

8 Claims, 13 Drawing Sheets

| DOT POSITION NUMBER / NOZZLE USAGE RATIO (%) | 1 | 2 | 3 | 4 | 5 | ... | |
|---|---|---|---|---|---|---|---|
| 100 | ● | ● | ● | ● | ● | ● | ● |
| 50 | ● | | ● | | ● | | ● |

IMAGE FORMING APPARATUS AND IMAGE FORMING METHOD

BACKGROUND

1. Technical Field

The present invention relates to image forming apparatuses and image forming methods.

2. Related Art

Ink jet printers are exemplary image forming apparatuses and record or print an image on an arbitrary recording medium, such as a paper sheet or a film, by ejecting ink droplets onto the recording medium to create a plurality of dots thereon. An exemplary ink jet printer performs a dot creating operation (pass) and a transport operation; in the dot creating operation, the head ejects ink droplets onto a recording medium through a plurality of nozzles formed in the head while moving over or scanning the medium in a main-scanning direction, thereby creating a dot array (also called a raster line) extending in a main-scanning direction, and in the transport operation, the head moves or is transported in a sub-scanning direction that intersects the main-scanning direction. Repeating the dot creating and transport operations creates dots arranged densely on the recording medium in both the main-scanning and sub-scanning directions, and these dots constitute an image.

To record high-quality images, some ink jet printers form a raster line on a medium through multiple passes while transporting the medium in the sub-scanning direction by an amount smaller than the width of the head. For example, JP-A-2010-17976 proposes an image forming method of printing an image, in which a print region is divided into sub-regions depending on an image to be recorded onto a recording medium and these sub-regions are scanned a different number of times.

When printing an image through multiple passes, an ink jet printer, as described above, creates different numbers of dots through respective nozzles arrayed in the sub-scanning direction by changing the numbers of ink droplets to be ejected from the nozzles. Unfortunately, if different numbers of ink droplets are ejected from the nozzles, the volume of the ink droplets ejected may differ. Thus, different sized dots may be created. Consequently, an image with prominent density nonuniformity, namely, a low-quality image might be recorded.

SUMMARY

The present invention has been made to solve at least a part of the above-described problem, and can be realized as the following embodiments and application examples.

An image forming apparatus according to application example 1 includes: a head having a plurality of nozzles which liquid can be ejected onto a medium; a scanning section moving the head in a main-scanning direction; and a transport section that transports the medium in a sub-scanning direction that intersects the main-scanning direction. A first region is formed in the head between a nozzle formed at a first end of the head and a first nozzle that is a first predetermined distance away, in the sub-scanning direction, from the nozzle formed at the first end. A second region is formed in the head between a nozzle formed at a second end of the head and a second nozzle that is a second predetermined distance away, in the sub-scanning direction, from the nozzle formed at the second end. When the head, the scanning section, and the transport section form an image on the medium, a moving-average nozzle usage ratio within a region between the first region and the second region changes at a lower rate than moving-average nozzle usage ratios within the first region and the second region.

According to application example 1, an image forming apparatus forms an image on a medium by repeatedly and alternately operating: a scanning section to cause a head having nozzles arranged in a sub-scanning direction to scan the medium in a main-scanning direction; and a transport section to transport the medium in the sub-scanning direction. More specifically, the image forming apparatus forms dot arrays, or raster lines, on the medium by using: the scanning section that moves the head in the main-scanning direction, the head ejecting different numbers of ink droplets through a plurality of nozzles arranged in the sub-scanning direction; and the transport section that transports the medium in the sub-scanning direction by an amount smaller than the width of the head in the sub-scanning direction. By printing the raster lines on the medium in the sub-scanning direction, an image is formed on the medium. Herein, a ratio of the number of ink droplets ejected from a certain nozzle upon main scanning to the number of dots forming a raster line is referred to as the nozzle usage ratio of this nozzle.

It is assumed that a first region is formed in the head between a nozzle formed at a first end of the head and a first nozzle that is a first predetermined distance away, in the sub-scanning direction, from the nozzle formed at the first end, and a second region is formed in the head between a nozzle formed at a second end of the head and a second nozzle that is a second predetermined distance away, in the sub-scanning direction, from the nozzle formed at the second end. When the image forming apparatus forms the raster lines, the moving-average nozzle usage ratio within a region between the first region and the second region, in which nozzles may generate prominent density nonuniformity, is set to change at a lower rate than moving-average nozzle usage ratios within the first region and the second region. This setting makes the nozzle usage ratio within the region between the first region and the second region change more gradually than the nozzle usage ratios within the first region and the second region, thereby reducing the risk of generating prominent density nonuniformity in a resultant image. It is therefore possible to provide an image forming apparatus that is capable of printing high-quality images.

Application Example 2

In the image forming apparatus according to application example 1, a larger number of nozzles are preferably formed within the region between the first region and the second region than within the first region and the second region.

According to application example 2, a larger number of nozzles are formed within the region between the first region and the second region than within the first region and the second region. This makes the nozzle usage ratio within the region between the first region and the second region change even more gradually, thereby further reducing the risk of generating prominent density nonuniformity in a resultant image.

Application Example 3

In the image forming apparatus according to application example 1, the nozzles formed at the first and second ends of the head preferably have a nozzle usage ratio of 1% or less.

According to application example 3, nozzles at the first and second ends of the head, which may generate lateral streaks when an error occurs upon the transport of the medium, are set to have a nozzle usage ratio of 1% or less. This setting reduces the risk of generating prominent lateral streaks.

Application Example 4

In the image forming apparatus according to application example 1, a third region is preferably formed between a nozzle displaced by one nozzle away from a location of the first nozzle toward a center of the head and a third nozzle that is a third predetermined distance away from the displaced nozzle in the sub-scanning direction. A fourth region is preferably formed between a nozzle displaced by one nozzle away from a location of the second nozzle toward the center of the head and a fourth nozzle that is a fourth predetermined distance away from the displaced nozzle in the sub-scanning direction. When the head, the scanning section, and the transport section transport the medium by a predetermined amount and form an image on the medium, moving-average nozzle usage ratios within the third region and the fourth region preferably change at a lower rate than moving-average nozzle usage ratios within the first region and the second region.

According to application example 4, suppose a third region is formed between a nozzle displaced by one nozzle away from a location of the first nozzle toward a center of the head and a third nozzle that is a third predetermined distance away from the displaced nozzle in the sub-scanning direction, and a fourth region is formed between a nozzle displaced by one nozzle away from a location of the second nozzle toward the center of the head and a fourth nozzle that is a fourth predetermined distance away from the displaced nozzle in the sub-scanning direction. When the image forming apparatus forms raster lines, moving-average nozzle usage ratios within the third region and the fourth region, in which nozzles may generate prominent density nonuniformity, are each set to change at a lower rate than moving-average nozzle usage ratios within the first region and the second region. This setting makes the nozzle usage ratios within the third region and the fourth region change more gradually than the nozzle usage ratios within the first region and the second region, thereby reducing the risk of generating prominent density nonuniformity in a resultant image. It is therefore possible to provide an image forming apparatus that is capable of printing high-quality images.

Application Example 5

In the image forming apparatus according to application example 4, a fifth region is preferably formed between a nozzle displaced by one nozzle away from a location of the third nozzle toward the center of the head and a fifth nozzle that is a fifth predetermined distance away from the displaced nozzle in the sub-scanning direction. A sixth region is preferably formed between a nozzle displaced by one nozzle away from a location of the fourth nozzle toward the center of the head and a sixth nozzle that is a sixth predetermined distance away from the displaced nozzle in the sub-scanning direction. When the head, the scanning section, and the transport section transport the medium by a predetermined amount and form an image on the medium, moving-average nozzle usage ratios within the third region and the fourth region preferably change at a lower rate than moving-average nozzle usage ratios within the first region, the second region, the fifth region, and the sixth region.

According to application example 5, suppose a fifth region is formed between a nozzle displaced by one nozzle away from a location of the third nozzle toward the center of the head and a fifth nozzle that is a fifth predetermined distance away from the displaced nozzle in the sub-scanning direction, and a sixth region is formed between a nozzle displaced by one nozzle away from a location of the fourth nozzle toward the center of the head and a sixth nozzle that is a sixth predetermined distance away from the displaced nozzle in the sub-scanning direction. When the image forming apparatus forms raster lines, moving-average nozzle usage ratios within the third region and the fourth region, in which nozzles may generate prominent density nonuniformity, are each set to change at a lower rate than moving-average nozzle usage ratios within the first region, the second region, the fifth region, and the sixth region. This setting makes the nozzle usage ratios within the third region and the fourth region change more gradually than the nozzle usage ratios within the first region, the second region, the fifth region, and the sixth region, thereby reducing the risk of generating prominent density nonuniformity in a resultant image. It is therefore possible to provide an image forming apparatus that is capable of printing high-quality images.

Application Example 6

In the image forming apparatus according to application example 5, the first predetermined distance is preferably the same as the sixth predetermined distance.

According to application example 6, since the first predetermined distance is the same as the sixth predetermined distance, the image forming apparatus can easily print an image through multiple passes. In addition, it is possible to set changing rates of nozzle usage ratios so as to reduce the risk of generating prominent density nonuniformity.

Application Example 7

In the image forming apparatus according to application example 5, a seventh region is preferably formed between the fifth region and the sixth region.

According to application example 7, since a seventh region is formed between the fifth region and the sixth region, it is possible to set the changing rates of nozzle usage ratios within the first to seventh regions so as to further reduce the risk of generating prominent density nonuniformity.

Application Example 8

An image forming method of an image forming apparatus according to application example 8 includes: moving a head having a plurality of nozzles in a main-scanning direction while causing the head to eject liquid onto the medium; and transporting the medium in a sub-scanning direction that intersects the main-scanning direction. A first region is formed in the head between a nozzle formed at a first end of the head and a first nozzle that is a first predetermined distance away, in the sub-scanning direction, from the nozzle formed at the first end. A second region is formed in the head between a nozzle formed at a second end of the head and a second nozzle that is a second predetermined distance away, in the sub-scanning direction, from the nozzle formed at the second end. When the medium is transported by a predetermined amount and the head forms an image on the medium, a moving-average nozzle usage ratio within a region between the first region and the second region changes at a lower rate than moving-average nozzle usage ratios within the first region and the second region.

According to application example 8, the image forming method of an image forming apparatus forms an image on the medium by repeatedly and alternately scanning a medium in a main-scanning direction with a head having nozzles arranged in a sub-scanning direction and transporting the medium in the sub-scanning direction. More specifically, the image forming apparatus forms dot arrays, or raster lines, on the medium by moving the head in the main-scanning direction, the head ejecting different numbers of ink droplets through the plurality of nozzles arranged in the sub-scanning direction; and transporting the medium in the sub-scanning direction by an amount smaller than the width of the head in the sub-scanning direction. By printing the raster lines on the medium in the sub-scanning direction, an image is formed on the medium. Herein, a ratio of the number of ink droplets ejected from a certain nozzle upon main scanning to the number of dots forming a raster line is referred to as the nozzle usage ratio of this nozzle.

It is assumed that a first region is formed in the head between a nozzle formed at a first end of the head and a first nozzle that is a first predetermined distance away, in the sub-scanning direction, from the nozzle formed at the first end, and a second region is formed in the head between a nozzle formed at a second end of the head and a second nozzle that is a second predetermined distance away, in the sub-scanning direction, from the nozzle formed at the second end. When the image forming apparatus forms the raster lines, a moving-average nozzle usage ratio within a region between the first region and the second region, in which nozzles may generate prominent density nonuniformity, is set to change at a lower rate than moving-average nozzle usage ratios within the first region and the second region. This setting makes the nozzle usage ratio within the region between the first region and the second region change more gradually than the nozzle usage ratios within the first region and the second region. It is therefore possible to provide an image forming method that can reduce the risk of forming density nonuniformity in an image.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 3:
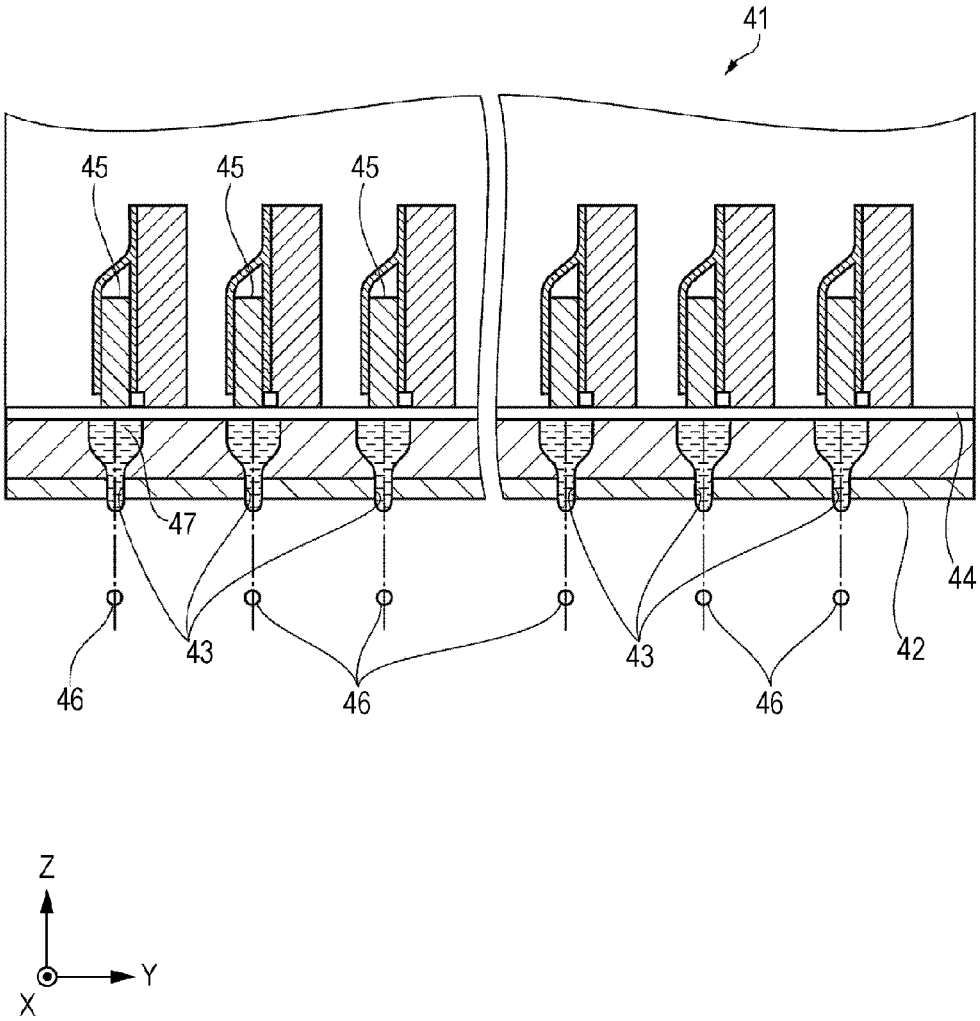
FIG. 3 illustrates the cross section of the head.
Figure 8A:
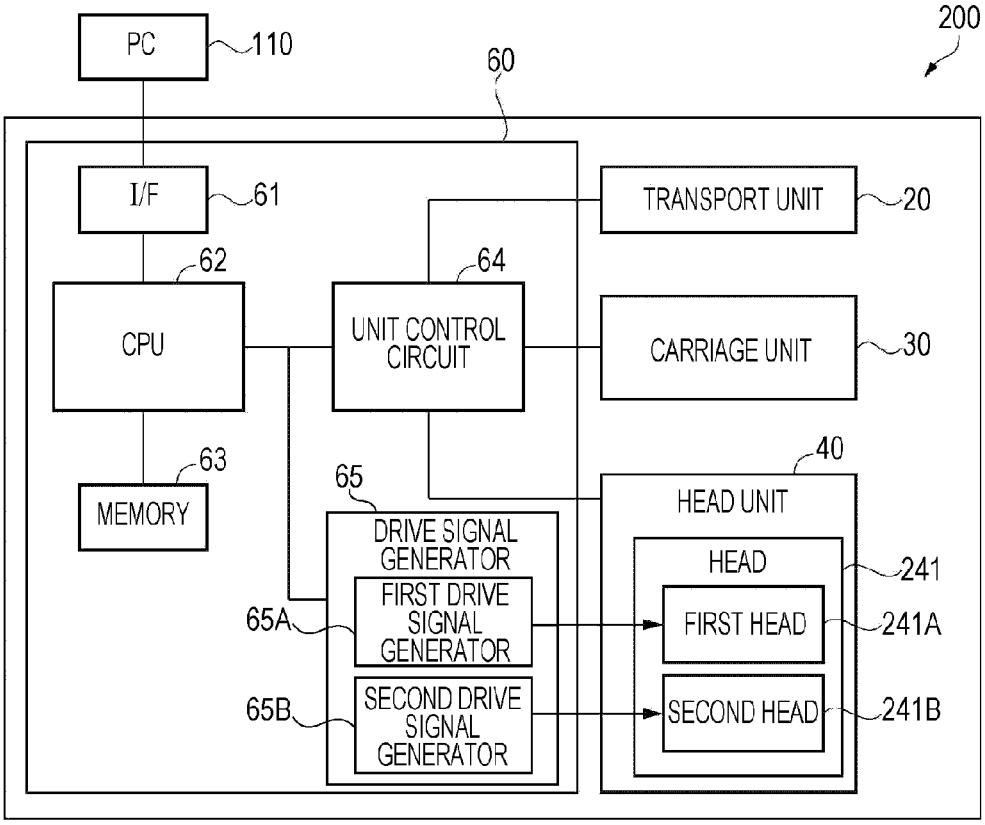
FIG. 8A is a block diagram of an overall configuration of an ink jet printer, which is an image forming apparatus according to a second embodiment of the invention.
Figure 8B:
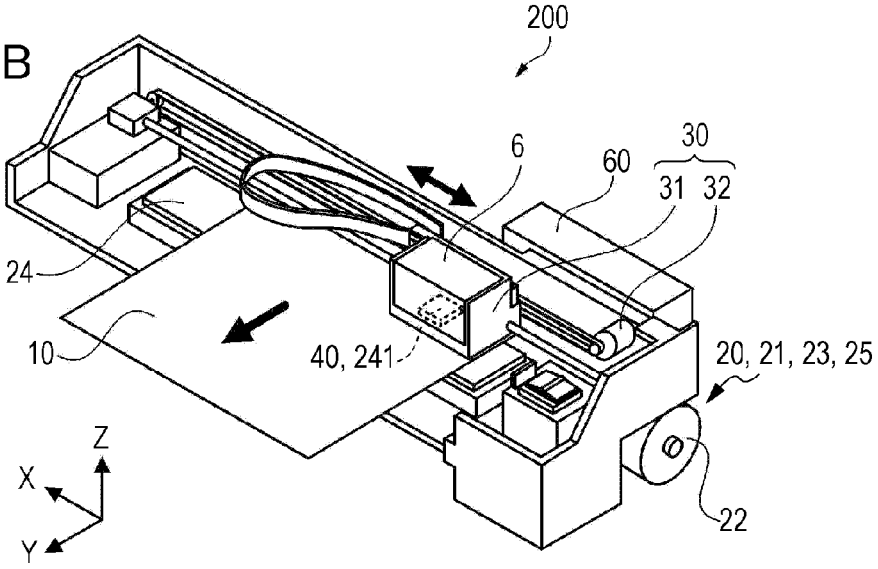
FIG. 8B is a perspective view of the ink jet printer.

Some embodiments of the invention will be described below with reference to the accompanying drawings. It should be noted that the scaling of layers and members illustrated in the drawings differs from a real one, and some layers and members are enlarged so as to be distinguishable from one another. In FIGS. 1B, 3, and 8B, the X-, Y-, and Z-axes that are orthogonal to one another are illustrated for the sake of convenience of explanation, and the direction of the arrow of each axis is referred to as the positive (+) direction, whereas the opposite direction is referred to as the negative (−) direction. Herein, a direction parallel to the X-axis is referred to as an "X axial direction" or a "main-scanning direction." A direction parallel to the Y-axis is referred to as a "Y axial direction" or a "sub-scanning direction." A direction parallel to the Z-axis is referred to as a "Z axial direction."

First Embodiment

Image Forming Apparatus

Figure 1A:
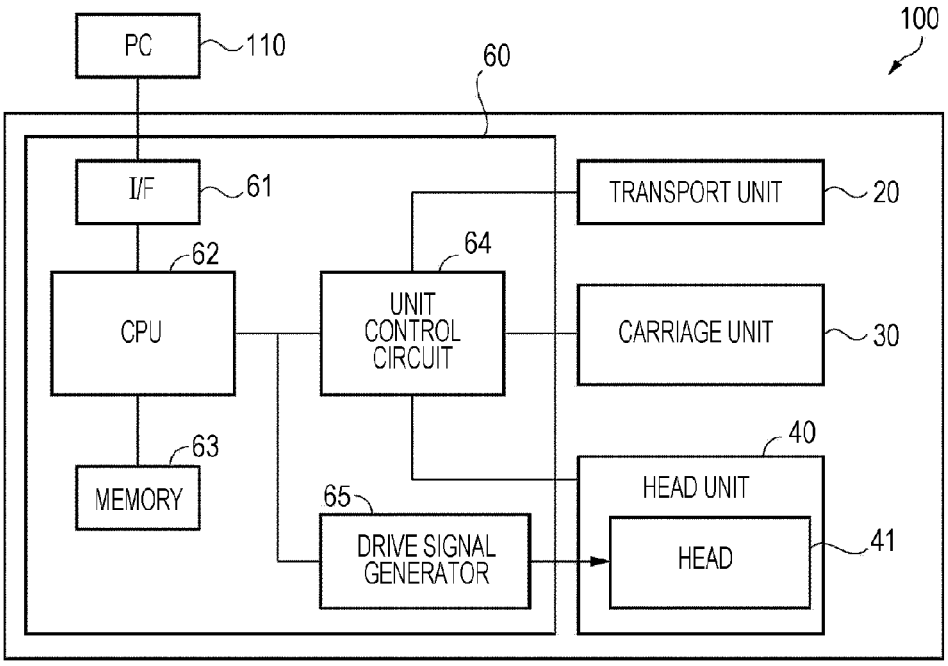
FIG. 1A is a block diagram of an overall configuration of an ink jet printer, which is an image forming apparatus according to a first embodiment of the invention.
Figure 1B:
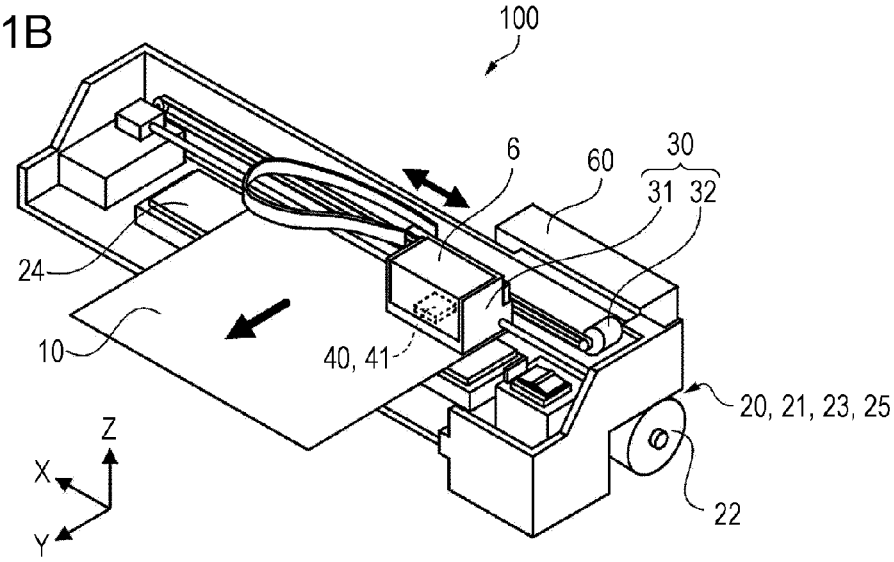
FIG. 1B is a perspective view of the ink jet printer.

FIG. 1A is a block diagram of an overall configuration of an ink jet printer 100, which is an image forming apparatus according to a first embodiment of the invention. FIG. 1B is a perspective view of the ink jet printer 100. First, a basic configuration of the ink jet printer 100 will be described.

Basic Configuration of Ink Jet Printer

The ink jet printer 100 includes a transport unit 20 as a transport section, a carriage unit 30 as a scanning section, a head unit 40, and a controller 60. When the ink jet printer 100 receives print data (image forming data) from a computer 110 as an external device, the controller 60 controls individual units, or the transport unit 20, the carriage unit 30, and the head unit 40. More specifically, the controller 60 controls the individual units in accordance with the print data received from the computer 110 to print or form an image on a paper sheet 10 as a medium.

The carriage unit 30 is the scanning section that causes a head 41 to scan or move over the paper sheet 10 in a predetermined moving direction, or in the X axial direction in FIG. 1B; this predetermined moving direction is referred to below as the "main-scanning direction." The carriage unit 30 includes a carriage 31 and a carriage motor 32. The carriage 31 has a head 41 and an ink cartridge 6; the head 41 is provided with a plurality of nozzles 43 (see FIGS. 2 and 3) through which inks can be ejected onto the paper sheet 10 in liquid form. The ink cartridge 6 stores the inks to be ejected from the head 41 and is detachably mounted in the carriage 31. The carriage 31 can reciprocate in the main-scanning direction and is driven by the carriage motor 32. The head 41 can thereby move in the main-scanning direction, or in the ±X axial directions.

The transport unit 20 is the transport section that transports or moves the paper sheet 10 in a direction that intersects the main-scanning direction, or in the Y axial direction in FIG. 1B; this direction is referred to below as the "sub-scanning direction." The transport unit 20 includes a feed rotor 21, a transport motor 22, a transport roller 23, a platen 24, and an ejection roller 25. The feed rotor 21 feeds the paper sheet 10 that has been inserted into the ink jet printer 100 through an insertion opening (not illustrated) to the interior of the ink jet printer 100. The transport roller 23 is driven by the transport motor 22 and transports the paper sheet 10 that has been fed by the feed rotor 21 to a printing area. The platen 24 supports the paper sheet 10 in the course of printing. The ejection roller 25 is installed downstream of the printing area in the sub-scanning direction and ejects the paper sheet 10 to the outside of the ink jet printer 100.

Figure 2:
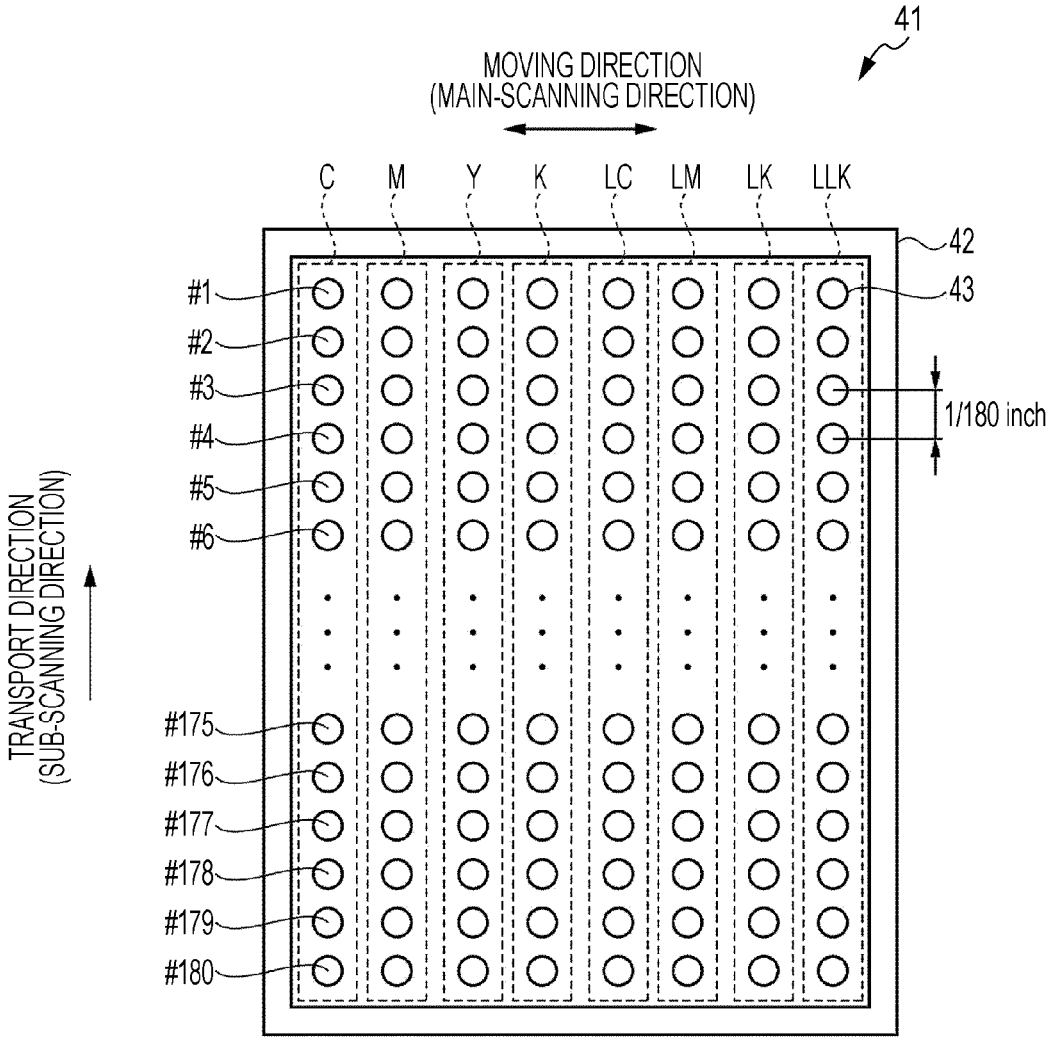
FIG. 2 illustrates exemplary nozzle arrays.

The head unit 40 ejects ink droplets onto the paper sheet 10 and is provided with the head 41 having a plurality of nozzles 43 (see FIG. 2). This head 41 is mounted in the carriage 31 and thus is movable in the main-scanning direction together with the carriage 31. The head 41 ejects ink droplets while moving in the main-scanning direction, creating dot arrays (raster lines) on the paper sheet 10 in the main-scanning direction.

The controller 60 controls the ink jet printer 100. This controller 60 includes an interface section 61, a CPU (Central Processing Unit) 62, a memory 63, a unit control circuit 64, and a drive signal generator 65. The interface section 61 allows the ink jet printer 100 to transmit/receive data to or from an external device, or the computer 110. The CPU 62 is an arithmetic processing unit that controls the entire ink jet printer 100. The memory 63 provides storage and working areas for programs to be executed by the CPU 62 and has a memory device such as a RAM (Random Access Memory) or an EEPROM (Electrically Erasable Programmable Read-Only Memory).

The CPU 62 controls the individual units, or the transport unit 20, the carriage unit 30, and the head unit 40, via the unit control circuit 64 in accordance with programs stored in the memory 63. The drive signal generator 65 generates drive signals for use in driving piezoelectric elements 45 (see FIG. 3) that eject ink droplets through the nozzles 43.

To print an image, the controller 60 ejects ink droplets onto a medium, or the paper sheet 10, through the nozzles 43 while causing the scanning section, or the carriage 31, to move the head 41 in the main-scanning direction. This operation is referred to as a "pass" or a "scanning step." As a result of this operation, a dot array (raster line) extending in the main-scanning direction is printed on the paper sheet 10. Then, the controller 60 causes the transport section, or the transport unit 20, to move the paper sheet 10 in the sub-scanning direction. This operation is referred to as a "transport step." The controller 60 repeats the scanning and transport steps, forming raster lines arranged in the sub-scanning direction on the paper sheet 10. In this way, an image is formed on the paper sheet 10. In this embodiment, the controller 60 transports the paper sheet 10 in the sub-scanning direction by an amount smaller than the width of the head 41 in the sub-scanning direction, thereby forming a single raster line through multiple passes. This printing operation is referred to as "n-pass printing (n: integer)," and n-th pass is referred to as a "pass n."

Configuration of Head

FIG. 2 illustrates exemplary arrays of nozzles 43 in the head 41. FIG. 3 illustrates the cross section of the head 41. As illustrated in FIG. 2, eight nozzle arrays are formed in the head 41, and a nozzle plate 42 is provided on the lower surface of the head 41 which is oriented in the −Z axial direction in FIG. 1B. The nozzles 43 are opened in the nozzle plate 42. The respective eight nozzle arrays eject dark cyan (C), dark magenta (M), yellow (Y), dark black (K), light cyan (LC), light magenta (LM), light black (LK), and ultra-light black (LLK) inks.

In each nozzle array, for example, 180 nozzles 43 with nozzle numbers #1 to #180 are disposed in the sub-scanning direction at regular spacings corresponding to 180 dpi (dots per inch). In FIG. 2, a smaller nozzle number #n (n=1 to 180) is assigned to a nozzle 43 disposed closer to the downstream side in the sub-scanning direction. It should be noted that the number of nozzle arrays and the types of inks are exemplary, and an arbitrary number of nozzle arrays and arbitrary types of inks may be used.

As illustrated in FIG. 3, the head 41 is provided with the nozzle plate 42 in which the nozzles 43 are formed. The upper surface of the nozzle plate 42 which is oriented in the +Z axial direction has cavities 47 that communicate with the opposing nozzles 43. The cavities 47 in the head 41 are supplied with inks stored in the ink cartridge 6.

The piezoelectric elements 45 and a vibration plate 44 are disposed on the upper side of the cavities 47 which is oriented in the +Z axial direction. The vibration plate 44 vibrates vertically or in ±Z axial directions, increasing or decreasing the inner volumes of the cavities 47. The piezoelectric elements 45 expand or shrink vertically, vibrating the vibration plate 44. The vertical expansion or shrinkage of the piezoelectric elements 45 vibrates the vibration plate 44. Then, the vibrating vibration plate 44 increases or decreases the inner volume of the cavities 47, exerting pressure on the cavities 47. In response, the inner pressures of the cavities 47 vary whereby the inks supplied to the cavities 47 are ejected through the nozzles 43.

When the head 41 receives the drive signals that are generated by the drive signal generator 65 (see FIG. 1A) and used to control and drive the piezoelectric elements 45, the piezoelectric elements 45 expand, causing the vibration plate 44 to decrease the inner volumes of the cavities 47. The decreased volumes of the cavities 47 cause the head 41 to eject the inks through the nozzles 43 in the form of ink droplets 46. In this embodiment, the pressurizing mechanism having vertical vibration type piezoelectric elements 45 is used; however, any other types of piezoelectric elements may be used. For example flexural deformation type of piezoelectric elements in which a lower electrode, a piezoelectric body layer, and an upper electrode are stacked may be used. Furthermore, the pressure generating mechanism may be a so-called electrostatic actuator that generates static electricity between electrodes and a vibration plate, deforming the vibration plate to eject ink droplets through nozzles. The head may be configured such that a heating element generates bubbles in the nozzles and the bubbles cause inks to be ejected in the form of ink droplets.

Nozzle Usage Rate and Density Nonuniformity

Next, a nozzle usage ratio will be described. As described above, a dot array, or a raster line, that extends in the main-scanning direction is printed on the paper sheet 10 through multiple passes. It should be noted that a nozzle at a nozzle usage ratio of 50% ejects the ink droplets 46 so as to create one half of all the dots forming a single raster line through a single pass. Assuming that a single raster line is made up of 1000 dots, a nozzle at a nozzle usage ratio of 50% ejects the ink droplet 46 so as to create 500 dots through a single pass.

Figures 4A, 4B:
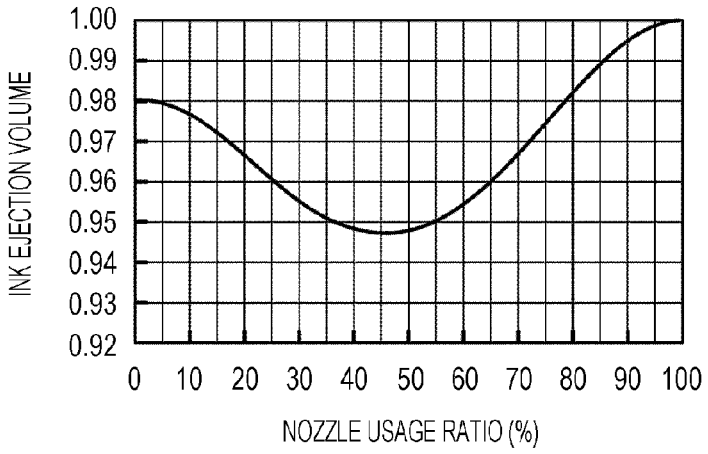
FIG. 4A is an exemplary graph showing a relationship between a nozzle usage ratio and an ink ejection volume.
FIG. 4B is an exemplary table showing a relationship between the nozzle usage ratio and a dot diameter.

FIG. 4A is an exemplary graph showing a relationship between a nozzle usage ratio and an ink ejection volume. FIG. 4B is an exemplary table showing a relationship between the nozzle usage ratio and a dot diameter. In FIG. 4A, the horizontal axis represents a nozzle usage ratio, which is a relative volume of an ink droplet 46 (see FIG. 3) that a single nozzle ejects through a single pass; the vertical axis represents an ink ejection volume, which is the volume of an ink droplet 46 ejected from a nozzle 43 (see FIG. 3) at a certain nozzle usage ratio relative to the volume of an ink droplet 46 ejected from the nozzle 43 at a nozzle usage ratio of 100%. As can be seen from FIG. 4A, the ink ejection volume of an ink droplet 46 ejected from the nozzle 43 varies with its nozzle usage ratio. More specifically, when the nozzle usage ratio of a nozzle 43 is changed, a voltage applied to the piezoelectric element 45 that vibrates the vibration plate 44 (see FIG. 3) to eject an ink droplet 46 through the nozzle 43 varies. In response, the ink ejection volume of the ink droplet 46 ejected from the nozzle 43 varies. This phenomenon is referred to as a frequency characteristic of the head 41. Assuming that a certain nozzle at a nozzle usage ratio of 50% ejects an ink droplet, its ink ejection volume becomes approximately 0.95 times the ink ejection volume of an ink droplet that the nozzle at a nozzle usage ratio of 100% ejects, due to the frequency characteristic of the head 41. In other words, the volume of the ink droplet 46 is decreased by approximately 5%.

FIG. 4B is an exemplary table showing a relationship between the nozzle usage ratio and a dot diameter. FIG. 4B illustrates, in the upper row, the images of dots in a raster line that a nozzle at a nozzle usage ratio of 100% forms; the dots are disposed at all the dot position numbers. In addition, FIG. 4B illustrates, in the lower row, the images of dots in the raster line that a nozzle at a nozzle usage ratio of 50% forms; the dots are disposed only at odd dot position numbers. Because of the frequency characteristic of the head 41, the ink ejection volume of an ink droplet 46 ejected from a nozzle at a nozzle usage ratio of 100% differs from that at a nozzle usage ratio of 50%. More specifically, each dot created by a nozzle at a nozzle usage ratio of 50% is smaller in size than that at a nozzle usage ratio of 100%. Thus, if raster lines that a nozzle at a nozzle usage ratio of 50% forms through 2-pass printing are close to each other, density nonuniformity between these raster lines may be prominent, because such raster lines are printed with a smaller total ink ejection volume than those formed by a nozzle at a nozzle usage ratio of 100%.

Nozzle Usage Rate

Figure 12B:
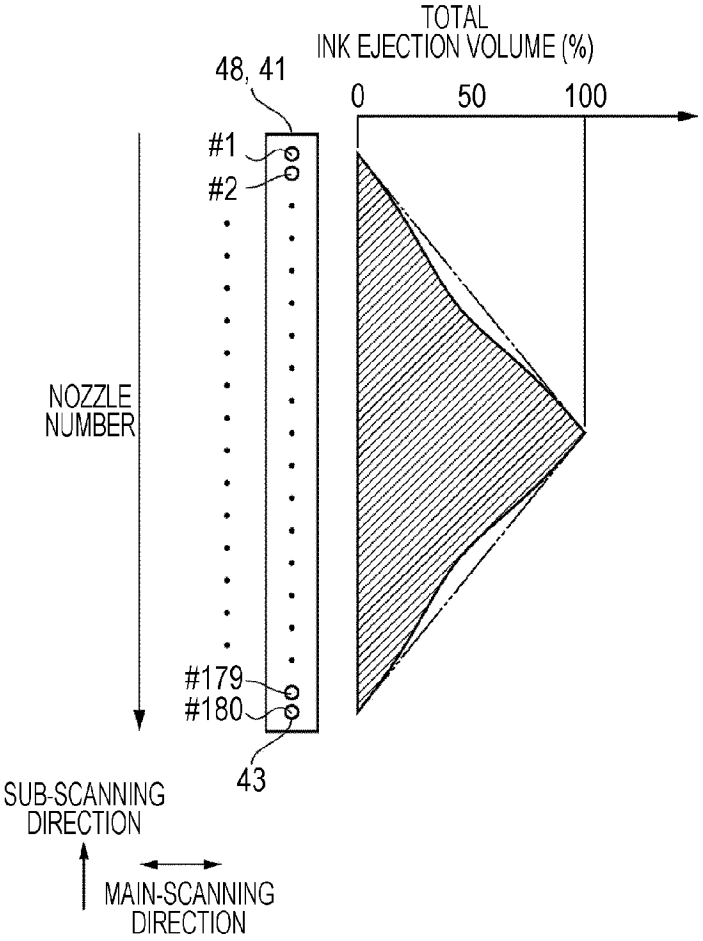
FIG. 12B is an exemplary mask pattern showing a relationship between the nozzle array and a total ink ejection volume in a related art.
Figure 12A:
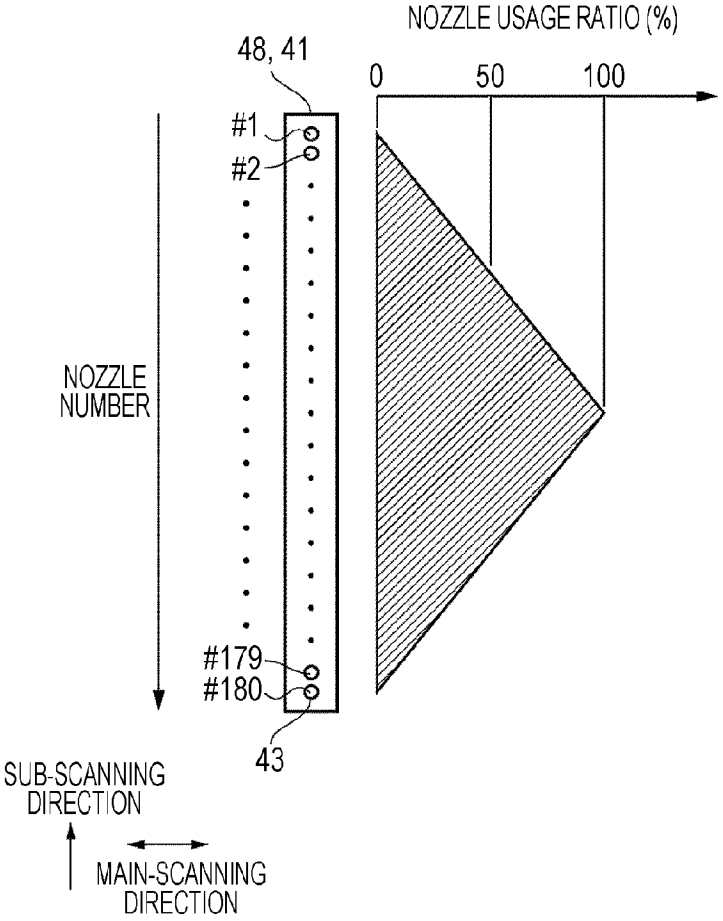
FIG. 12A is an exemplary mask pattern showing a relationship between a nozzle array and a nozzle usage ratio in a related art.

First, a nozzle usage ratio and a total ink ejection volume in the related art will be described, and then those in this embodiment will be described. FIG. 12A is an exemplary mask pattern showing a relationship between a nozzle array and a nozzle usage ratio in a related art. FIG. 12B is an exemplary mask pattern showing a relationship between the nozzle array and a total ink ejection volume in a related art. Thereinafter, for the sake of simplicity of explanation, a single nozzle array 48 is formed in a head 41, and a single color ink will be used for printing.

FIG. 12A illustrates the nozzle array 48 on the left side and an exemplary mask pattern on the right side which is formed by determining the moving averages of the nozzle usage ratios of nozzles with the nozzle numbers #1 to #180 arrayed in the sub-scanning direction and connecting the determined moving-average nozzle usage ratios. This mask pattern is obtained when a single raster line is formed through 2-pass printing. In the mask pattern, the nozzle usage ratio linearly increases from the nozzle 43 with the nozzle number #1 or #180 at an end of the head 41 to the central nozzle 43. FIG. 12B illustrates the nozzle array 48 on the left side and the total ink ejection volume of the ink droplet 46 (see FIG. 3) on the right side which is ejected from the nozzles 43 through a single pass. If the ink droplets 46 having the same volume are ejected, the mask pattern of the nozzle usage ratio could be coincident with that of the total ink ejection volume. As illustrated in FIG. 4A, however, the ink ejection volume of an ink droplet 46 ejected from a nozzle 43 varies with its nozzle usage ratio. Therefore, the mask pattern of the total ink ejection volume of ink droplets ejected through a single pass is not coincident with the mask pattern in FIG. 12A.

Figure 5B:
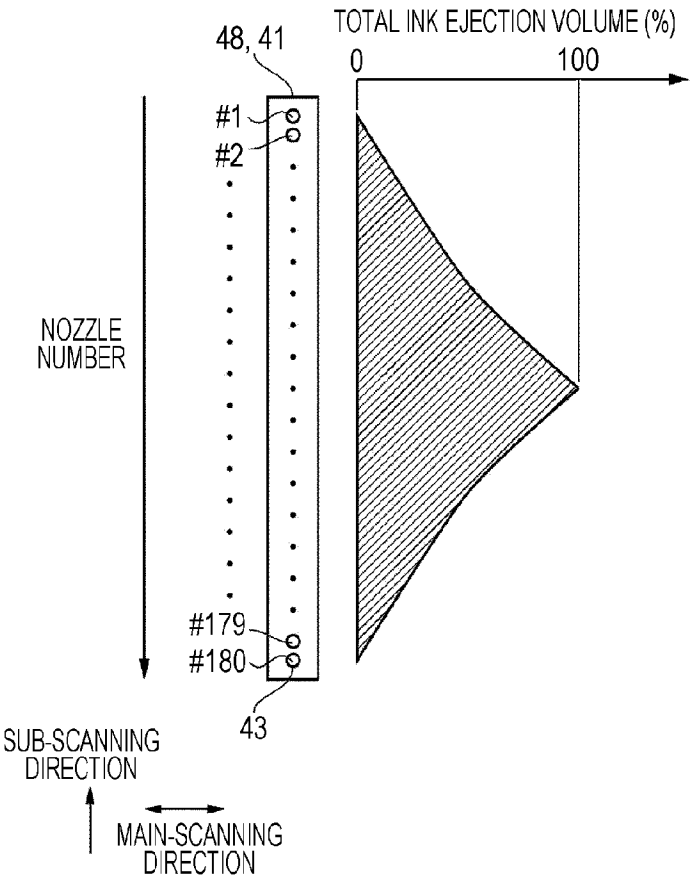
FIG. 5B is an exemplary mask pattern showing a relationship between the nozzle array and a total ink ejection volume.
Figure 5A:
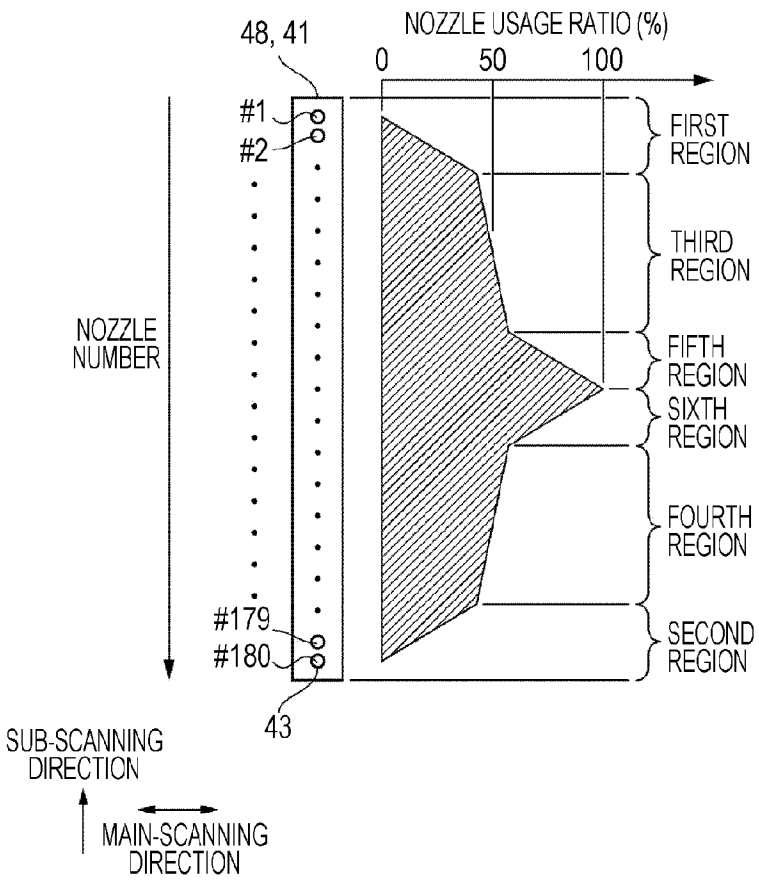
FIG. 5A is an exemplary mask pattern showing a relationship between a nozzle array and a nozzle usage ratio.

Next, the nozzle usage ratio and the total ink ejection volume in this embodiment will be described with reference to FIGS. 5A and 5B. FIG. 5A is an exemplary mask pattern showing a relationship between a nozzle array and a nozzle usage ratio; FIG. 5B is an exemplary mask pattern showing a relationship between the nozzle array and a total ink ejection volume.

FIG. 5A illustrates a nozzle array 48 on the left side and a mask pattern on the right side which is formed by connecting the region of nozzle array 48 to moving-average nozzle usage ratios of the nozzles 43 with the nozzle numbers #1 to #180 arrayed in the sub-scanning direction. As illustrated in FIG. 5A, the region of the head 41 is divided into first to fifth regions in the sub-scanning direction. The first region spans from a first edge of the head 41 toward the center by a predetermined distance (first predetermined distance). The third region spans from the inner edge of the first region toward the center by a predetermined distance (third predetermined distance). The fifth region spans from the inner edge of the third region toward the center by a predetermined distance (fifth predetermined distance). The second region spans from a second edge of the head 41 toward the center by a predetermined distance (second predetermined distance). The fourth region spans from the inner edge of the second region toward the center by a predetermined distance (fourth predetermined distance). The sixth region spans from the inner edge of the fourth region toward the center by a predetermined distance (sixth predetermined distance). In this case, the first and second predetermined distances may or may not be the same as each other. This may apply to both the third and fourth predetermined distances and/or both the fifth and sixth predetermined distances. In this embodiment, suppose the first predetermined distance is the same as the second predetermined distance, the third predetermined distance is the same as the fourth predetermined distance, and the fifth predetermined distance is the same as the sixth predetermined distance.

According to the mask pattern that shows the nozzle usage ratio of the head 41, the nozzle usage ratio of the head 41 increases from the nozzle 43 with the nozzle number #1 or #180 at an end to the central nozzle 43 across the three regions and with two inflection points. If a single raster line is formed through multiple passes, the nozzles 43 at both ends of the head 41 create a smaller number of dots. This can make the lateral streaks less prominent when lateral streaks appear in the main-scanning direction due to an occurrence of an error upon the transport of the paper sheet 10. In this embodiment, the nozzle usage ratios of the nozzles 43 with the nozzle numbers #1 and #180 at both ends of the head 41 are each set to 1% or less. This setting can form images with lateral streaks less prominent.

As can be seen from the mask pattern in this embodiment, the nozzle usage ratio for the nozzles 43 contained within the third region changes at a lower rate than those within the first and the fifth regions. Likewise, the nozzle usage ratio for the nozzles 43 contained within the fourth region changes at a lower rate than those within the second and sixth regions.

The number of nozzles 43 contained within the third region is set larger than those in the first and fifth regions. Likewise, the number of nozzles 43 contained within the fourth region is set larger than those in the second and sixth regions. This setting allows the nozzle usage ratios within the third and fourth regions to change more gradually than those within the first, second, fifth, and sixth regions.

FIG. 5B illustrates the nozzle array 48 on the left side and the total ink ejection volume of the ink droplets 46 (see in FIG. 3) on the right side which are ejected from the nozzles 43 through a single pass. This embodiment employs the mask pattern illustrated in FIG. 5A, successfully mitigating an influence of a change in ink ejection volumes which would be caused due to the frequency characteristic of the head 41 in comparison with the related art illustrated in FIGS. 12A and 12B.

Image Forming Method

Figure 6:
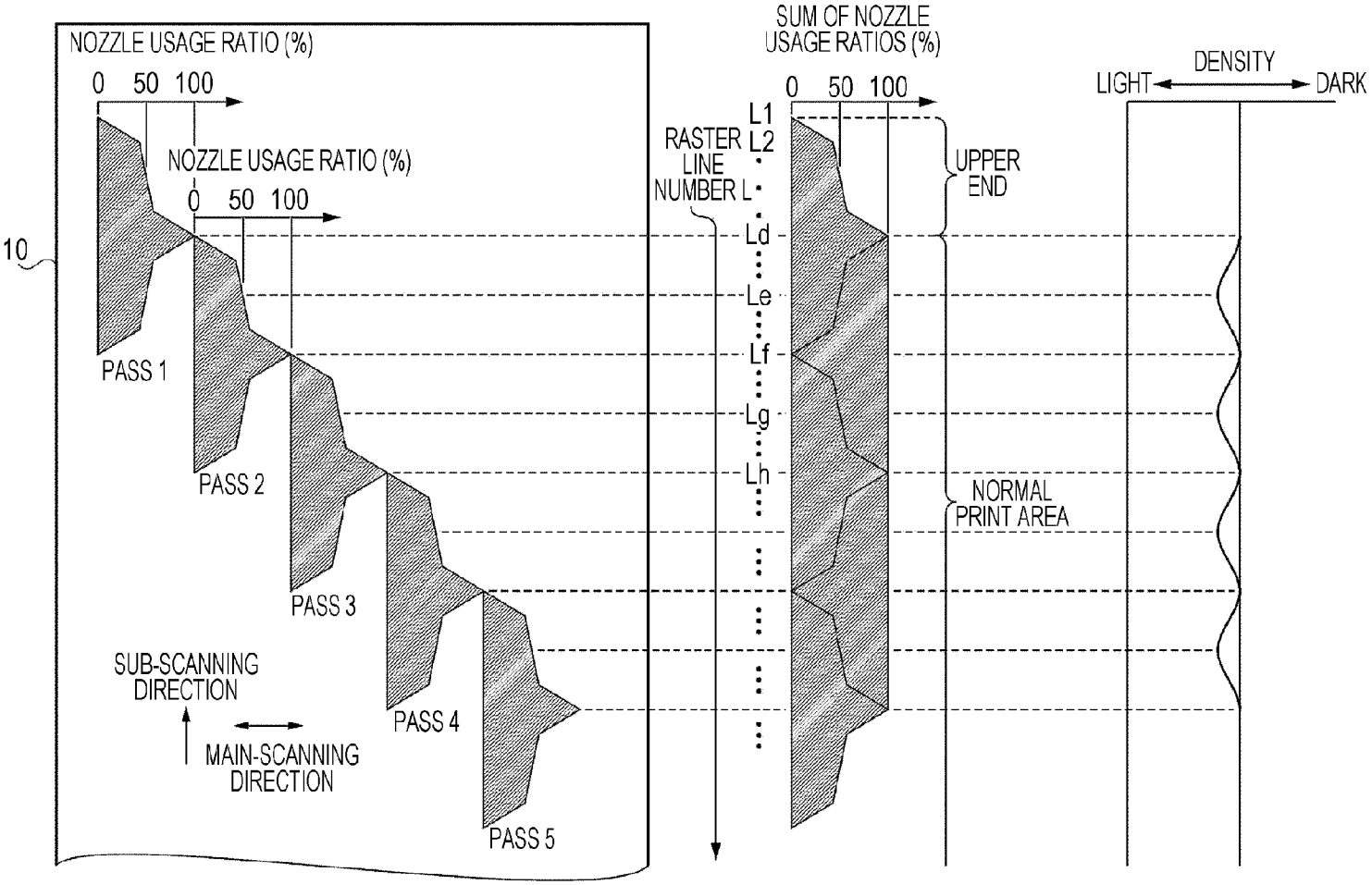
FIG. 6 is an illustrative view of a method of forming raster lines through 2-pass printing.

Next, an image forming method will be described. FIG. 6 is an illustrative view of a method of forming raster lines through 2-pass printing. In FIG. 6, the positions of the head 41 (see FIG. 1A) are indicated by the mask patterns as illustrated in FIG. 5A. The image forming method using an image forming apparatus includes: a scanning step (pass) in which the head 41 with the plurality of nozzles 43 scans the paper sheet 10 in the main-scanning direction while ejecting the ink droplets 46; and a transport step in which the paper sheet 10 is transported in the sub-scanning direction that intersects the main-scanning direction.

FIG. 6 illustrates the relative positions of the paper sheet 10 and the head 41 when the pass (scanning step) and the transport (transport step) are repeated. In the scanning step, the head 41 moves from the upper edge of the paper sheet 10 in the main-scanning direction while ejecting ink droplets through the nozzles 43 with the nozzle numbers #1 to #180 (see FIG. 5A). In the transport step, the transport unit 20 transports the paper sheet 10 by an amount according to 90 nozzles, which is one half of the nozzles formed in the head 41 in the sub-scanning direction. In FIG. 6, passes 1 to 5 are performed. In FIG. 6, the head 41 moves over the paper sheet 10; however, the paper sheet 10 or both of the head 41 and the paper sheet 10 may move instead. In short, any of the head 41 and the paper sheet 10 may move in such a way that their relative position changes. In this embodiment, suppose the paper sheet 10 is transported in the sub-scanning direction. It should be noted that the mask patterns that represent the positions of the head 41 are illustrated diagonally in the main-scanning direction so that the mask patterns do not overlap upon passes, and therefore the positional relationship between the paper sheet 10 and the head 41 is not correct.

FIG. 6 illustrates, in the middle, the sum of the nozzle usage ratios when a raster line is formed through 2-pass printing. Some upper raster lines for which the sums of the nozzle usage ratios do not reach 100% are subjected to upper-end processing that involves slight feeding of the paper sheet 10. This upper-end processing is a known technique and will not be described accordingly.

First, in the transport step, the transport unit 20 transports the paper sheet 10 to a predetermined area. Then, in the scanning step for pass 1, the head 41 ejects the ink droplets 46 (see FIG. 3) through the nozzles 43 (see FIG. 5A) at respective nozzle usage ratios, creating dots making up raster lines L1 to Lf. For example since dots are created on the raster line Ld by a nozzle 43 at a nozzle usage ratio of 100%, these dots are referred to as "100% dots." Since a half of the 100% dots are created on the raster line Le by a nozzle 43 at a nozzle usage ratio of 50%, these dots are referred to as "50% dots." No dots are created on the raster line Lf by a nozzle 43 at a nozzle usage ratio of 0%.

Next, at the transport step, the transport unit 20 transports the paper sheet 10 in the sub-scanning direction by an amount according to 90 nozzles. Continuing, in the scanning step for pass 2, the head 41 ejects the ink droplets 46 through the nozzles 43 at respective nozzle usage ratios, creating dots on the raster lines Ld to Lh. Consequently, the 100% dots are created on the raster lines Ld to Lf. As for the raster line Ld, for example, no dots are created by a nozzle 43 at a nozzle usage ratio of 0% in the scanning step for pass 2. As for the raster line Le, the 50% dots are created by a nozzle 43 at a nozzle usage ratio of 50%. Through passes 1 and 2, the 100% dots are created on the raster lines Ld and Lh. The 100% dots are created on the raster line Lf by a nozzle 43 at a nozzle usage ratio of 100%. In this case, dots are created on the raster lines Ld to Lf by different nozzles 2-pass printing. After that, the scanning and transport steps are repeated so that raster lines made up of the 100% dots are arranged in the sub-scanning direction. In this way, an image is printed on the paper sheet 10 through 2-pass printing.

FIG. 6 shows the density of the printed image on the right side. As described above, the nozzles 43 with the nozzle numbers #1 to #180 at different nozzle usage ratios eject different ink ejection volumes of ink droplets 46, creating different sized dots. Therefore, density nonuniformity may be generated in the printed image. For example nozzles 43 at a nozzle usage ratio of 100% creates dots on the raster lines Ld, Lf, and Lh, so the resultant raster lines Ld, Lf, and Lh become dark. In contrast, nozzles 43 at a nozzle usage ratio of 50% create dots on the raster lines Le and Lg, so the resultant raster lines Le and Lg become light.

Figure 13:
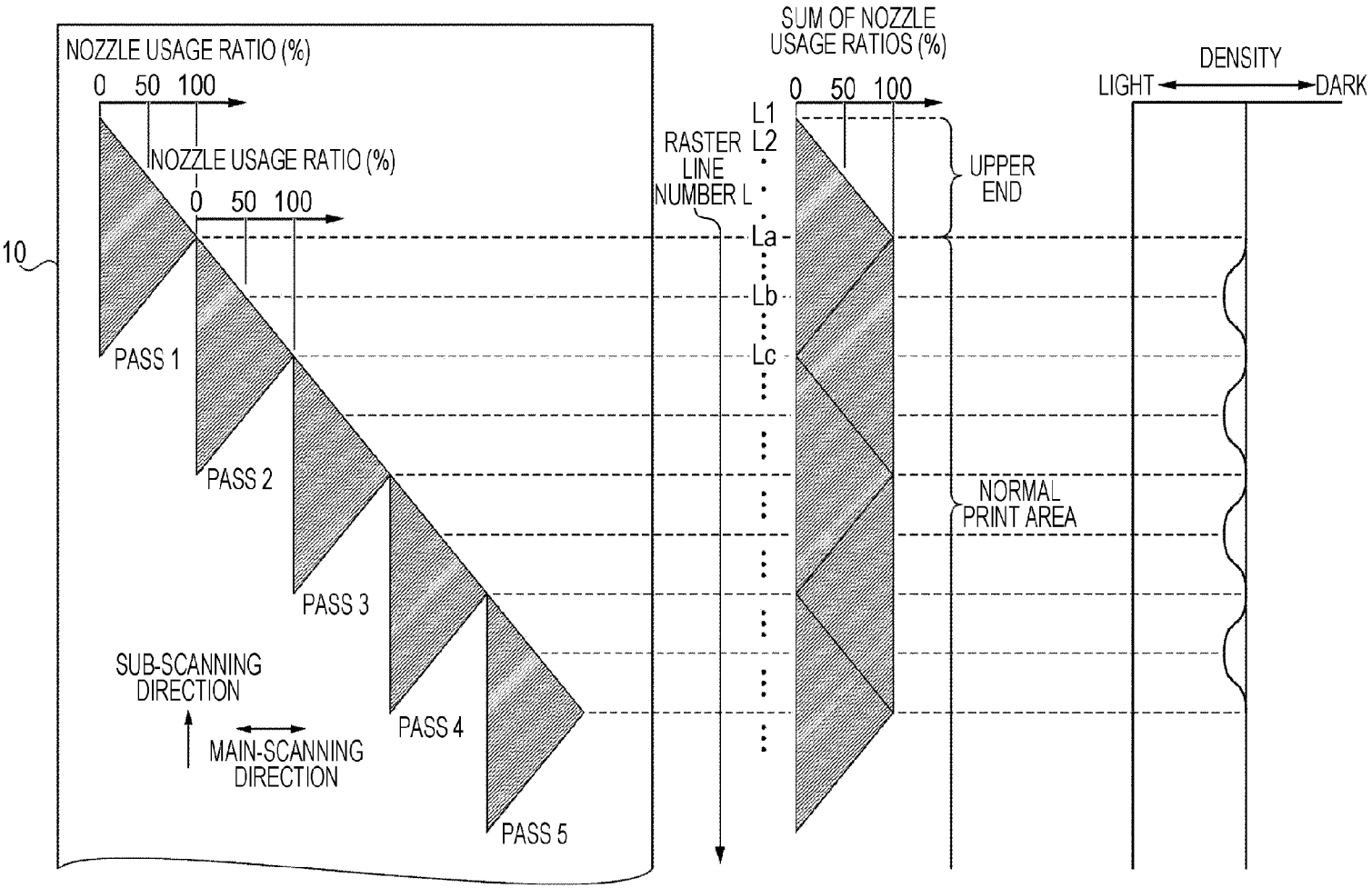
FIG. 13 is an illustrative view of a method of forming raster lines through 2-pass printing in a related art.

A description will be given of density nonuniformity of an image formed in the related art. FIG. 13 is an illustrative view of a method of forming raster lines through 2-pass printing in a related art. FIG. 13 has the same configuration as FIG. 6 and illustrates an image printed with the mask pattern of the related art illustrated in FIG. 12A and in the same manner as in this embodiment. The display format of FIG. 13 is the same as in FIG. 6, and the image forming method employed is the same as that in this embodiment. Therefore, the display format and image forming method in FIG. 13 will not be described in detail.

FIG. 13 shows the density of the image printed in the related art on the right side. The nozzles 43 with the nozzle numbers #1 to #180 at different nozzle usage ratios eject different ink ejection volumes of ink droplets 46, creating different sized dots. Therefore, density nonuniformity may be generated in the printed image. Nozzles 43 at a nozzle usage ratio of 100% create dots on the raster lines La and Lc, so the resultant raster lines La and Lc become dark. A nozzle 43 at a nozzle usage ratio of 50% creates dots on the raster line Lb, so the resultant raster line Lb becomes light. Since this image is printed with the mask pattern of the related art, the total ink ejection volumes of the ink droplets 46 ejected through a single pass greatly differ from one another (see FIG. 12B). Consequently, prominent density nonuniformity may be generated. More specifically, prominent density nonuniformity may be generated in the region between the raster lines La and Lb.

Referring back to FIG. 6, a description will be given of the density of an image formed in this embodiment. Since this embodiment employs the mask pattern illustrated in FIG. 5A, the total ink ejection volumes of the ink droplets 46 ejected through a single pass do not differ from one another more greatly than those in the related art illustrated in FIG. 12B (see FIG. 5B). In this case, the density nonuniformity can be less prominent. More specifically, for example the region between the raster lines Ld and Le have a more uniform density than that in the related art illustrated in FIG. 13, and thus less prominent density nonuniformity can be generated in the resultant image.

Figure 7:
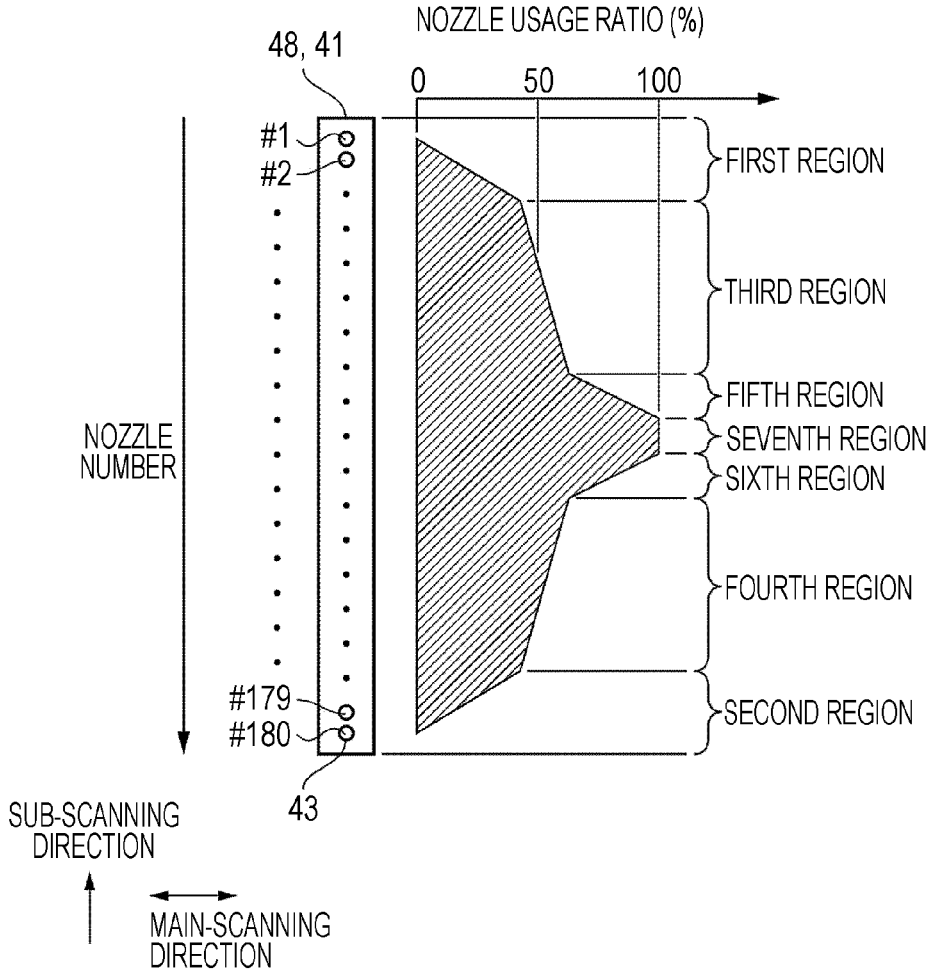
FIG. 7 is a modification of the mask pattern.

There is no limitation on a mask pattern in this embodiment. A modification of a mask pattern will be described below. FIG. 7 is a modification of the mask pattern. As illustrated in FIG. 7, the mask pattern may have a seventh region between a fifth region and a sixth region. This mask pattern can be used to print an image with density nonuniformity even less prominent. In this mask pattern, the nozzle usage ratio in each of the first to sixth regions linearly changes; however, the nozzle usage ratio may change in a nonlinear or curved fashion. In this embodiment, a raster line is formed through 2-pass printing; however, a raster line may be formed through at least 3-pass printing.

An image forming apparatus (ink jet printer 100) in the first embodiment described above produces the following effects. The ink jet printer 100 performs: a pass (scanning step) in which a head 41 ejects ink droplets 46 onto a paper sheet 10 through nozzles 43 while moving in a main-scanning direction by means of a scanning section; and transport (transport step) in which a transport section transports the paper sheet 10 in a sub-scanning direction. By repeating the scanning and transport steps alternately, raster lines that extend in the main-scanning direction are formed through 2-pass printing. If the region of the head 41 is divided into first to sixth regions, nozzles 43 contained within the third and fourth regions are more likely to generate prominent density nonuniformity in a resultant image than the first, second, fifth, and sixth regions. Therefore, the nozzle usage ratio for nozzles 43 contained within the third and fourth regions changes at a lower rate than those within the first, second, fifth, and sixth regions. In addition, larger numbers of nozzles 43 are contained within the third and fourth regions than within the first, second, fifth, and sixth regions. This configuration mitigates an influence of a change in ink ejection volumes which would be caused due to the frequency characteristic of the head 41, allowing the ink jet printer 100 to form an image with density nonuniformity less prominent. It is therefore possible to provide an image forming apparatus (ink jet printer 100) and an image forming method that are capable of printing high-quality images.

If raster lines are formed through multiple passes, the nozzle usage ratios of nozzles 43 with nozzle numbers #1 and #180 provided at both ends of the head 41 are each set to 1% or less, because these nozzles are more likely to print prominent bounding lines. The ink jet printer 100 can thereby form an image with lateral streaks less prominent when lateral streaks appear in the main-scanning direction due to an occurrence of an error upon the transport of the paper sheet 10.

Second Embodiment

Figure 9:
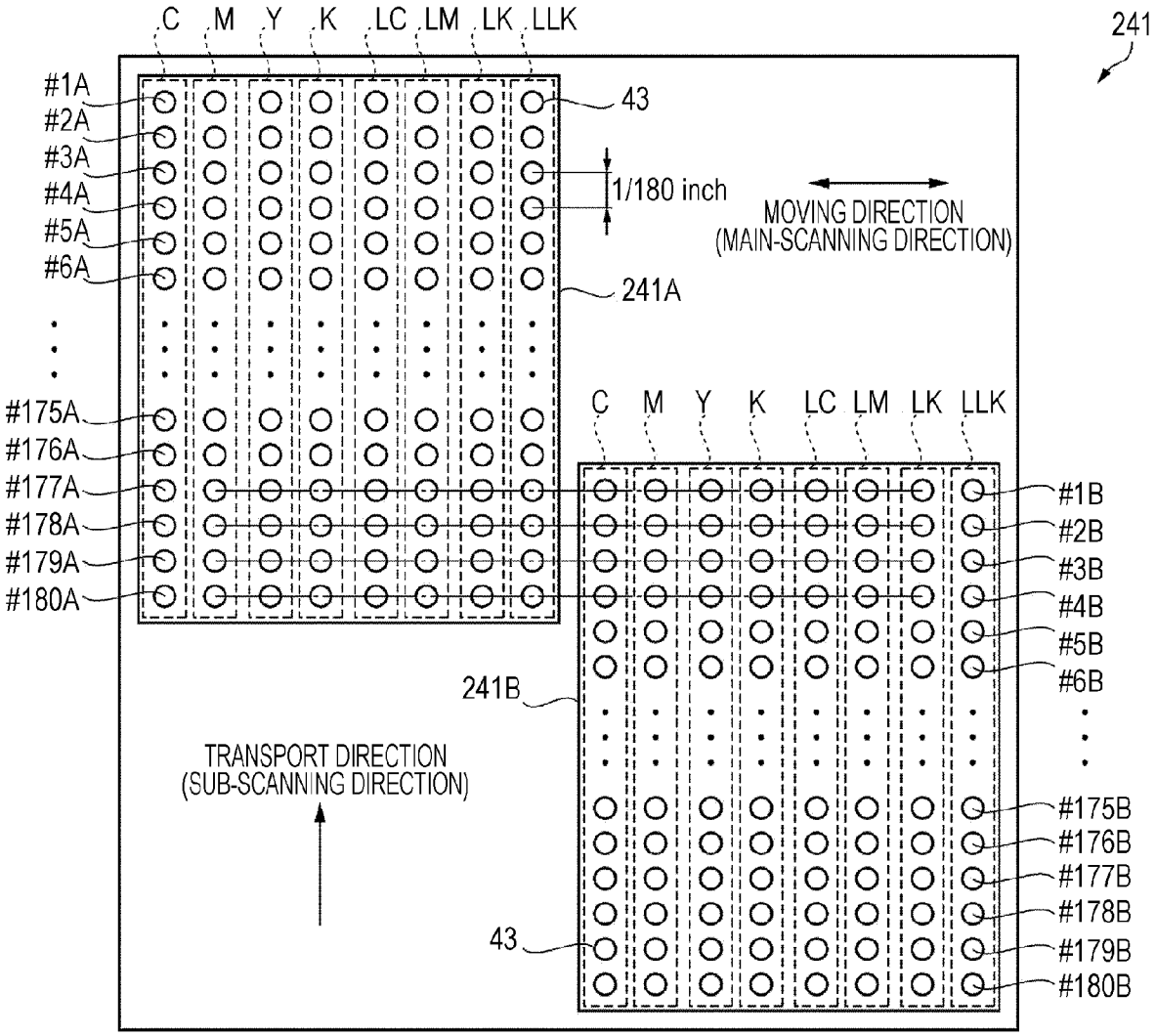
FIG. 9 illustrates exemplary nozzle arrays in the heads.
Figure 10A:
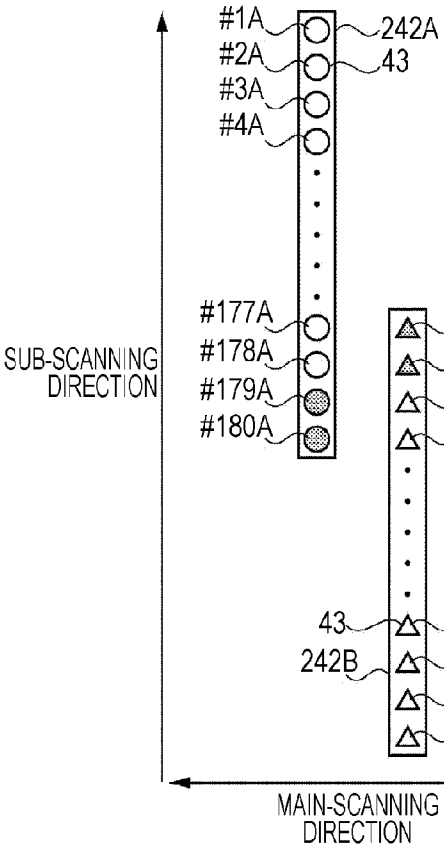
FIGS. 10A, 10B, and 10C illustrate a head set as a virtual head set.
Figure 10B:
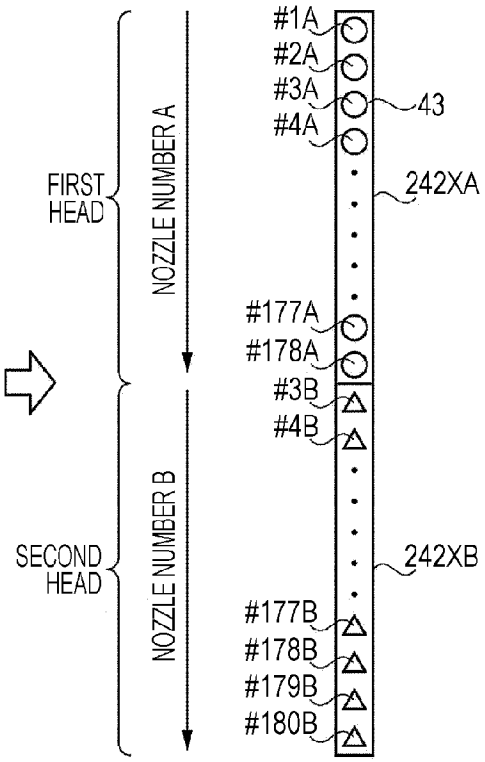
Figure 10C:
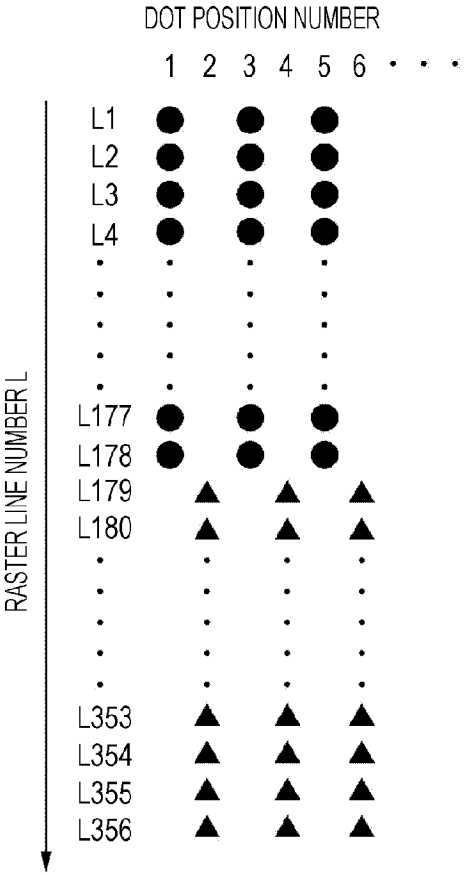
Figure 11:
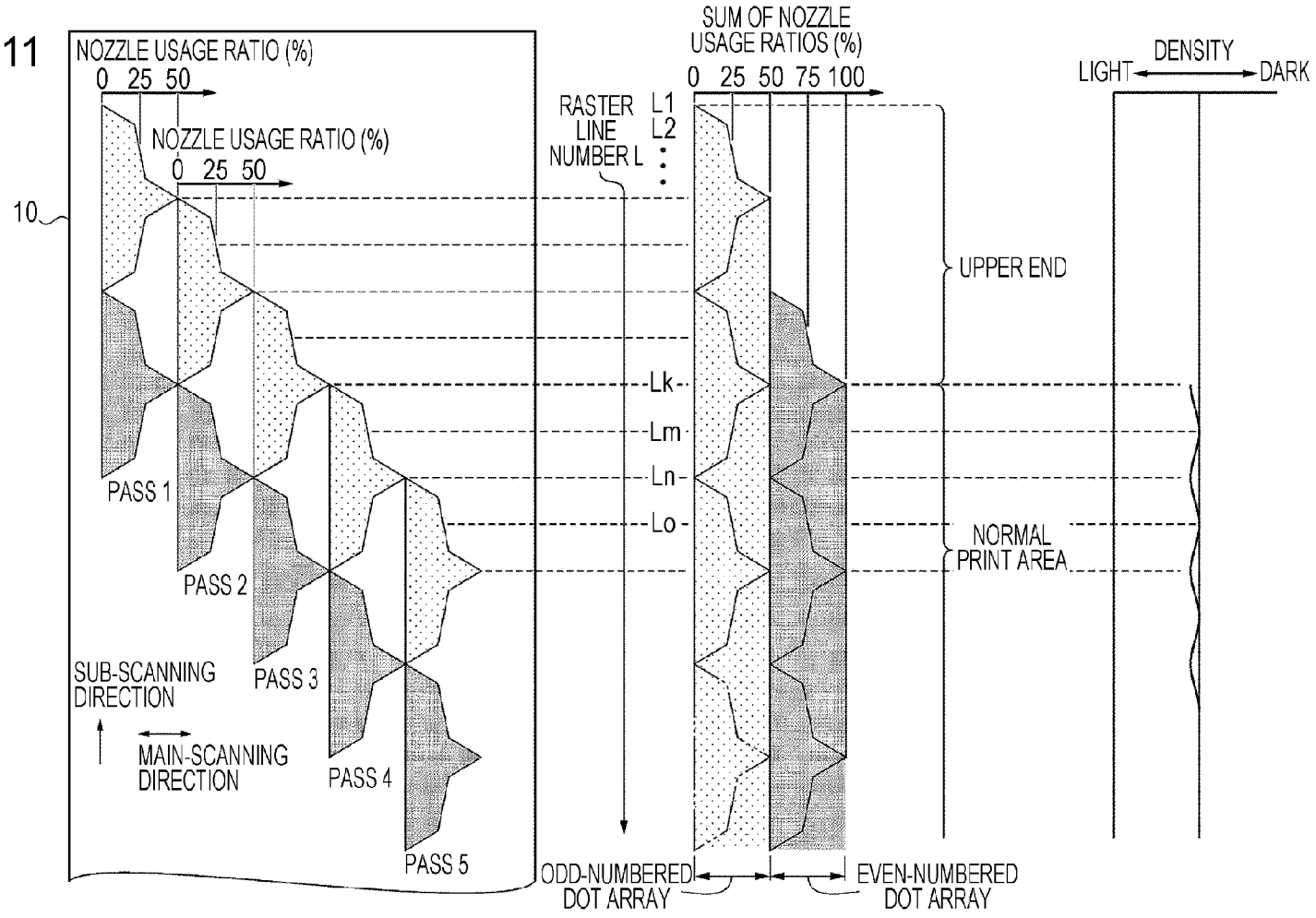
FIG. 11 is an illustrative view of a method of forming raster lines with the two heads through 2-pass printing.

An ink jet printer 200, which is an image forming apparatus according to a second embodiment of the invention, differs from the ink jet printer 100 in the first embodiment in having two heads. FIG. 8A is a block diagram of an overall configuration of the ink jet printer 200, which is an image forming apparatus according to the second embodiment of the invention. FIG. 8B is a perspective view of the ink jet printer 200. FIG. 9 illustrates exemplary nozzle arrays. FIGS. 10A, 10B, and 10C illustrate a head set as a virtual head set. FIG. 11 is an illustrative view of a method of forming raster lines through 2-pass printing. The image forming apparatus according to the second embodiment will be described with reference to FIGS. 8A to 10C. Constituent elements that are the same as in the first embodiment are denoted by the same reference characters and will not be described.

First, a description will be given of an overall configuration of the ink jet printer 200 as the image forming apparatus. A head unit 40 is provided with a head 241 having a plurality of nozzles. This head 241 is mounted in a carriage 31 and is movable in a main-scanning direction together with the carriage 31. The head 241 ejects ink droplets while moving in the main-scanning direction, creating dot arrays (raster lines) on a paper sheet 10 in the main-scanning direction. The head 241 includes a first nozzle group 241A as a first head and a second nozzle group 241B as a second head.

A controller 60 has a drive signal generator 65 that includes a first drive signal generator 65A and a second drive signal generator 65B. The first drive signal generator 65A generates drive signals for use in driving piezoelectric elements 45 (see FIG. 3) that cause the first nozzle group 241A as the first head to eject ink droplets. The second drive signal generator 65B generates drive signals for use in driving piezoelectric elements 45 that causes the second nozzle group 241B as the second head to eject ink droplets.

Nozzle Array and Head Set

FIG. 9 illustrates exemplary arrays of nozzles 43 formed in the head 241 provided with the first nozzle group 241A as the first head and the second nozzle group 241B as the second head. Each of the first nozzle group 241A and the second nozzle group 241B has eight arrays of nozzles 43 opened on the lower surface of the head 241 which is oriented in the −Z axial direction in FIG. 8B.

The first nozzle group 241A is disposed downstream of the second nozzle group 241B in the sub-scanning direction. Further, four nozzles in each nozzle array in the first nozzle group 241A are disposed at the same locations in the sub-scanning direction as corresponding four nozzles in each nozzle array in the second nozzle group 241B. For example the nozzles with nozzle number #177A in the first nozzle group 241A are disposed at the same locations in the sub-scanning direction as the nozzles with nozzle number #1B in the second nozzle group 241B. A combination of nozzle arrays in the first nozzle group 241A and the second nozzle group 241B which eject the same ink, or inks having the same composition, is referred to as a "head set."

FIGS. 10A, 10B, and 10C illustrate a head set as a virtual head set. Thereinafter, for the sake of simplicity of explanation, a nozzle array 242A as the first head and a nozzle array 242B as the second head are combined to constitute a head set that prints an image with a single ink. The four upstream nozzles 43 with the nozzle numbers #177A to #180A in the nozzle array 242A are disposed at the same locations in the sub-scanning direction as the four downstream nozzles 43 with the nozzle numbers #1B to #4B in the nozzle array 242B. Thereinafter, the four nozzles 43 with the nozzle numbers #177A to #180A in the nozzle array 242A and the four nozzles 43 with the nozzle numbers #1B to #4B in the nozzle array 242B are referred to as "aligned nozzles."

In FIGS. 10A, 10B, and 10C, the nozzles 43 in the nozzle arrays 242A and 242B are denoted by circular marks and triangular marks, respectively, and nozzles 43 that eject no ink droplets or form no dots are hatched. Of the aligned nozzles 43 in the nozzle array 242A, the nozzles with the nozzle numbers #177A and #178A eject ink droplets but the nozzles with the nozzle numbers #179A and #180A eject no ink droplets. Likewise, of the aligned nozzles 43 in the nozzle array 242B, the nozzles with the nozzle numbers #1B and #2B eject no ink droplets but the nozzles with the nozzle numbers #3B and #4B eject ink droplets. As illustrated in FIG. 10B, the first head from which nozzles ejecting no ink droplets are removed is represented by a nozzle array 242XA, and the second head from which nozzles ejecting no ink droplets are removed is represented by a nozzle array 242XB. Furthermore, both the nozzle arrays 242XA and 242XB are represented by a single virtual head set 242X. Thereinafter, a method of creating dots will be described using the single virtual head set 242X instead of two independent heads.

FIG. 10C illustrates dots created by the nozzle arrays 242XA and 242XB as the first and second heads, respectively. In the ink jet printer 200 in this embodiment, the nozzle array 242XA as the first head creates dots on raster lines at odd-numbered dot locations in the main-scanning direction, and the nozzle array 242XB as the second head creates dots on raster lines at even-numbered dot locations in the main-scanning direction. Alternatively, the nozzle array 242XA as the first head may create dots at even-numbered dot locations, and the nozzle array 242XB as the second head may create dots at odd-numbered dot locations.

Image Forming Method

FIG. 11 is an illustrative view of a method of forming raster lines with the two heads through 2-pass printing. In FIG. 11, the positions of the head set 242X (see FIGS. 10A to 10C) are represented by mask patterns, each of which indicates the nozzle usage ratios of the nozzles 43. Each mask pattern indicated by the nozzle arrays 242XA and 242XB has regions correspond to the sixth regions, or the first to sixth regions, in the first embodiment illustrated in FIG. 5A, and its nozzle usage ratios are one half of those of the mask pattern in the first embodiment. FIG. 11 illustrates relative positions of the paper sheet 10 and the head set 242X in the sub-scanning direction when a pass (scanning step) and transport (transport step) are repeated five times. In the scanning step, the head set 242X moves from the upper edge of the paper sheet 10 in the main-scanning direction while ejecting ink droplets through the nozzles 43 with the nozzle numbers #1A to #180B. In the transport step, a transport unit 20 transports the paper sheet 10 by an amount according to 89 nozzles, which is one half of the nozzles formed in the nozzle arrays 242XA and 242XB in the sub-scanning direction. In FIG. 11, the head set 242X moves over the paper sheet 10; however, the paper sheet 10 or both of the head set 242X and the paper sheet 10 may move instead. In short, any of the head set 242X and the paper sheet 10 may move in such a way that their relative position changes. In this embodiment, suppose the paper sheet 10 is transported in the sub-scanning direction. It should be noted that the mask patterns that represent the positions of the head set 242X through passes are illustrated diagonally in the main-scanning direction so that the mask patterns do not overlap, and therefore the positional relationship between the paper sheet 10 and the head 41 is not correct.

The nozzle array 242XA as the first head creates dots on raster lines at odd-numbered dot locations through 2-pass printing, whereas the nozzle array 242XB as the second head creates dots on raster lines at even-numbered dot locations through 2-pass printing (see FIGS. 10A to 10C). In other words, under independent controls, the first head forms raster lines by creating dots at odd-numbered dot locations, whereas the second head forms raster lines by creating dots at even-numbered dot locations. Therefore, each of the first and second heads has nozzle usage ratios that are one half of those of a single head in the first embodiment (see FIG. 5A). Thereinafter, raster lines made up of dots that the first head creates at odd-numbered dot locations are referred to as odd-numbered raster lines, whereas raster lines made up of dots that the second head creates at even-numbered dot locations are referred to as even-numbered raster lines.

As illustrated in FIG. 11, the ink jet printer 200 repeats the scanning step in which dots are created and the transport step in which the paper sheet 10 is transported in the sub-scanning direction by an amount according to 89 nozzles. Consequently, raster lines for which the sums of nozzle usage ratios are 100% are formed in a normal print area below a raster line Lk. Some upper raster lines for which the sums of the nozzle usage ratios do not reach 100% are subjected to upper-end processing that involves slight feeding of the paper sheet 10. This upper-end processing is a known technique and will not be described accordingly.

A description will be given of a method in which the first head forms odd-numbered raster lines. Through passes 3 and 4 and the scanning step, an image is printed on odd-numbered raster lines to be, for example the raster lines Lk to Ln on the normal print area. To give an example, as for the odd-numbered raster line to be the raster line Lk, a nozzle 43 at a nozzle usage ratio of 50% creates dots (all dots to be created thereon) through the scanning step for pass 3. Then, a nozzle 43 at a nozzle usage ratio of 0% creates no dots through the scanning step for pass 4. To give another example, as for the odd-numbered raster line to be the raster line Lm, a nozzle 43 at a nozzle usage ratio of 25% creates dots (50% of all dots to be created) through the scanning step for pass 3. Then, a nozzle 43 at a nozzle usage ratio of 25% creates dots (50% of all dots) through the scanning step for pass 4. After that, the first head repeats the scanning and transport steps in this manner, printing an image with dots created only at odd-numbered dot locations through 2-pass printing.

A description will be given of a method in which the second head forms even-numbered raster lines. Through passes 1 and 2 and the scanning step, an image is printed on even-numbered raster lines to be, for example the raster lines Lk to Ln on the normal print area. To give an example, as for the even-numbered raster line to be the raster line Lk, a nozzle 43 at a nozzle usage ratio of 50% creates dots (all dots to be created thereon) through the scanning step for pass 1. Then, a nozzle 43 at a nozzle usage ratio of 0% creates no dots through scanning step for pass 2. To give another example, as for the even-numbered raster line to be the raster line Lm, a nozzle 43 at a nozzle usage ratio of 25% creates dots (50% of all dots to be created thereon) through the scanning step for pass 1. Then, a nozzle 43 at a nozzle usage ratio of 25% creates dots (50% of all dots) through scanning step for pass 2. After that, the second head repeats the scanning and transport steps in this manner, printing an image with dots created only at even-numbered dot locations through 2-pass printing.

FIG. 11 shows the density of the printed image on the right side. As described in the first embodiment, nozzles 43 with nozzle numbers #1A to #180B at different nozzle usage ratios eject different ink ejection volumes of ink droplets 46, creating different sized dots. Therefore, the printed image may have density nonuniformity. For example dots are created on the raster lines Lk and Ln by a nozzle 43 at a nozzle usage ratio of 50%, and thus the resultant raster lines Lk and Ln become light. Dots are created on the raster lines Lm and Lo by nozzles 43 at a nozzle usage ratio of 25%, and thus the resultant raster lines Lm and Lo become slightly darker than the raster lines Lk and Ln.

An image forming apparatus (ink jet printer 200) in the second embodiment described above produces the following effects. The ink jet printer 200 includes two heads, more specifically a first nozzle group 241A as a first head and a second nozzle group 241B as a second head. With these heads, images can be printed at a high speed with density nonuniformity less prominent.

The entire disclosure of Japanese Patent Application No. 2014-217045, filed Oct. 24, 2014 is expressly incorporated reference herein.

What is claimed is:

1. An image forming apparatus comprising:

a head having a plurality of nozzles which liquid can be ejected onto a medium;

a scanning section moving the head in a main-scanning direction; and a transport section that transports the medium in a sub-scanning direction intersecting the main-scanning direction, wherein a first region is formed in the head between a nozzle formed at a first end of the head and a first nozzle that is a first predetermined distance away from the nozzle formed at the first end in the sub-scanning direction, a second region is formed in the head between a nozzle formed at a second end of the head and a second nozzle that is a second predetermined distance away from the second end in the sub-scanning direction, and when the head, the scanning section, and the transport section form an image on the medium, a moving-average nozzle usage ratio within a region between the first region and the second region changes at a lower rate than moving-average nozzle usage ratios within the first region and the second region.

2. The image forming apparatus according to claim 1, wherein a larger number of nozzles are formed within the region between the first region and the second region than within the first region and the second region.

3. The image forming apparatus according to claim 1, wherein the nozzles formed at the first and second ends of the head each have a nozzle usage ratio of 1% or less.

4. The image forming apparatus according to claim 1, wherein a third region is formed between a nozzle displaced by one nozzle away from a location of the first nozzle toward a center of the head and a third nozzle that is a third predetermined distance away from the displaced nozzle in the sub-scanning direction, a fourth region is formed between a nozzle displaced by one nozzle away from a location of the second nozzle toward the center of the head and a fourth nozzle that is a fourth predetermined distance away from the displaced nozzle in the sub-scanning direction, and when the head, the scanning section, and the transport section transport the medium by a predetermined amount and form an image on the medium, moving-average nozzle usage ratios within the third region and the fourth region each change at a lower rate than moving-average nozzle usage ratios within the first region and the second region.

5. The image forming apparatus according to claim 4, wherein a fifth region is formed between a nozzle displaced by one nozzle away from a location of the third nozzle toward the center of the head and a fifth nozzle that is a fifth predetermined distance away from the displaced nozzle in the sub-scanning direction, a sixth region is formed between a nozzle displaced by one nozzle away from a location of the fourth nozzle toward the center of the head and a sixth nozzle that is a sixth predetermined distance away from the displaced nozzle in the sub-scanning direction, and when the head, the scanning section, and the transport section transport the medium by a predetermined amount and form an image on the medium, moving-average nozzle usage ratios within the third region and the fourth region each change at a lower rate than moving-average nozzle usage ratios within the first region, the second region, the fifth region, and the sixth region.

6. The image forming apparatus according to claim 5, wherein the first predetermined distance is the same as the sixth predetermined distance.

7. The image forming apparatus according to claim 5, wherein a seventh region is formed between the fifth region and the sixth region.

8. An image forming method comprising:

moving a head having a plurality of nozzles in a main-scanning direction while causing the head to eject liquid onto the medium; and transporting the medium in a sub-scanning direction intersecting the main-scanning direction, wherein a first region is formed in the head between a nozzle formed at a first end of the head and a first nozzle that is a first predetermined distance away, in the sub-scanning direction, from the nozzle formed at the first end, a second region is formed in the head between a nozzle formed at a second end of the head and a second nozzle that is a second predetermined distance away, in the sub-scanning direction, from the nozzle formed at the second end, and when the medium is transported by a predetermined amount and the head forms an image on the medium, a moving-average nozzle usage ratio within a region between the first region and the second region changes at a lower rate than moving-average nozzle usage ratios within the first region and the second region.

* * * * *